US007575346B1

(12) United States Patent
Horng et al.

(10) Patent No.: US 7,575,346 B1
(45) Date of Patent: Aug. 18, 2009

(54) LAMP

(75) Inventors: Alex Horng, Kaohsiung (TW); Zhi-Hao Zhong, Kaohsiung (TW); Heng-Yu Hu, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 0 days.

(21) Appl. No.: 12/193,069

(22) Filed: Aug. 18, 2008

(30) Foreign Application Priority Data

Jul. 22, 2008 (TW) ..... 97127803 A

(51) Int. Cl.
*F21V 29/00* (2006.01)

(52) U.S. Cl. ..... 362/373; 362/294

(58) Field of Classification Search ..... 362/218, 362/264, 294, 373, 96; 165/80.3; 361/697; 257/712

See application file for complete search history.

(56) References Cited

U.S. PATENT DOCUMENTS 6,498,395 B2 * 12/2002 Baek et al. ..... 257/722
6,864,513 B2 * 3/2005 Lin et al. ..... 257/99
7,144,135 B2 12/2006 Martin et al.
7,175,329 B1 * 2/2007 Chou ..... 362/612
7,244,058 B2 7/2007 DiPenti et al.
7,438,448 B2 * 10/2008 Chen ..... 362/373
2008/0055909 A1 * 3/2008 Li ..... 362/294
2009/0046473 A1 * 2/2009 Tsai et al. ..... 362/373
2009/0052175 A1 * 2/2009 Xu et al. ..... 362/249
2009/0084531 A1 * 4/2009 Scordino et al. ..... 165/104.34

* cited by examiner

*Primary Examiner*—Thomas M Sember
(74) *Attorney, Agent, or Firm*—Alan Kamrath; Kamrath & Associates PA

(57) ABSTRACT

A lamp comprises a housing, a heat sink, a light emitting member, a fan and a blocking ring. The housing includes an outlet section and an inlet section formed on the wall thereof. The heat sink is mounted inside the housing and includes a base plate and a plurality of fins, with the fins being close to the outlet section of the housing and arranged around the base plate to form a chamber. Each of the fins has a first end facing the inlet section of the housing and a second end connecting with the base plate. The light emitting member is fixed to the base plate of the heat sink. The fan is fixed inside the chamber of the heat sink. The blocking ring is mounted inside the housing and between the inlet section and the heat sink and includes an inlet hole aligned with the chamber of the heat sink. By the blocking ring, parts of the heated air flows are blocked from flowing back to the inlet section to avoid turbulence resulting from flowing back air flows. Consequently, the air flows risen by the fan and receiving the heat inside the housing can flow smoothly to out of the housing through the outlet section to enhance heat dissipating efficiency of the heat sink and the fan.

11 Claims, 7 Drawing Sheets

LAMP

BACKGROUND OF THE INVENTION

1. Field of the Invention

The present invention relates to a lamp, more particularly, to a lamp that can automatically dissipate heat generated by the lamp itself.

2. Description of the Related Art

Referring to FIG. 1, a conventional lamp 9 that can dissipate heat generated by the lamp 9 itself includes a housing 91 forming a lens 911 and a base 912 on two ends thereof respectively, a light emitting member 92, a heat sink 93 and a fan 94. The housing 91 has an inlet section 913 and an outlet section 914 on the wall thereof between the lens 911 and the base 912. The light emitting member 92, the heat sink 93 and the fan 94 are inside the housing 91, with two ends of the heat sink 93 respectively connecting with the housing 91 and the light emitting member 92. Besides, an outer surface of the heat sink 93 forms a plurality of fins 931 jointly surrounding a chamber 932 that receives the fan 94.

In use, the lamp 9 is generally coupled to a lamp holder (not illustrated) set on a wall, ceiling or table, so as to electrically connect to a power supply through the base 912 for the light emitting member 92 to emit light penetrating the lens 911 for illuminating. Furthermore, heat generated by the light emitting member 92 can be transmitted to the fins 931 of the heat sink 93 and then be further transmitted to outer spaces of the housing 91 through the outlet section 914. In detail, for removing said heat from the lamp 9 to the outer spaces, air flows "A" are generated by the fan 94 and pass through the inlet section 913, gaps between any two adjacent fins 931, and the outlet section 914 in sequence. Therefore, life of the light emitting member 92 is extended. Although heat from the light emitting member 92 can be dissipated by the heat sink 93 and the fan 94, referring again to FIG. 1, parts of the air flows "A", designated as "a", easily flow back to the inlet section 913 through the gaps between any two adjacent fins 931 from the chamber 932 after the air flows "A" being risen by the fan 94 and flowing through the inlet section 913 and into the chamber 932. Unfortunately, the air flows "a" may block the air flows "A" with the heat from flowing to the outer spaces of the housing 91 through the outlet section 914 and may cause turbulence near the inlet section 913, and these lower heat dissipating efficiency of the heat sink 93 and the fan 94. As a result, life of the light emitting member 92 of the lamp 9 is not extended effectively.

SUMMARY OF THE INVENTION

It is therefore the primary objective of this invention to provide a lamp that overcomes the problems of the prior art described above to enhance heat dissipating efficiency.

The present invention solves the problems in the field of lamp by providing, in a preferred form, a lamp includes a housing, a heat sink, a light emitting member, a fan and a blocking ring. The housing includes a lens and a base on two ends thereof, with an outlet section and an inlet section being formed on the wall of the housing. The heat sink is mounted inside the housing and includes a base plate and a plurality of fins, with the fins being close to the outlet section of the housing and arranged around the base plate to form a chamber. Each of the fins has a first end facing the inlet section of the housing and a second end connecting with the base plate. The light emitting member is fixed to the base plate of the heat sink and faces the lens of the housing, with the light emitting member electrically connecting to the base of the housing. The fan is fixed inside the chamber of the heat sink. The blocking ring is mounted inside the housing and between the inlet section and the heat sink and includes an inlet hole aligned with the chamber of the heat sink. By the blocking ring, parts of the heated air flows are blocked from flowing back to the inlet section to avoid turbulence resulting from flowing back air flows. Accordingly, the air flows risen by the fan and receiving the heat inside the housing can flow smoothly to out of the housing through the outlet section to enhance heat dissipating efficiency of the heat sink and the fan.

In an example, an outer diameter of the blocking ring is larger than that of the heat sink. Accordingly, a gap letting air flows flow back to the inlet section after passing by the fins is largely reduced.

In another example, the outer edge of the blocking ring forms a flange extending in a direction from the first ends to the second ends of the fins for fitting on the outer lateral wall of the fins close to the first ends thereof. Accordingly, the convenience of combination between the blocking ring and the heat sink is improved.

In a further example, the blocking ring includes a first flange and a second flange formed on two opposite sides of the outer edge thereof and extending axially from the outer edge thereof and the housing including a first shell and a second shell, with the first and second flanges contacting with the first and second shells respectively. Accordingly, the blocking ring is sandwiched and fixed between the first and second shells, so that the combinations between the blocking ring and the first and second shells are firm.

In still another example, there is a cushion disposed inside the chamber and the fan is fixed on the cushion. Accordingly, vibration of the operating fan is reduced to reduce the noise resulting from the vibration.

Further scope of the applicability of the present invention will become apparent from the detailed description given hereinafter. However, it should be understood that the detailed description and specific examples, while indicating preferable embodiments of the invention, are given by way of illustration only, since various will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

Figure 1:
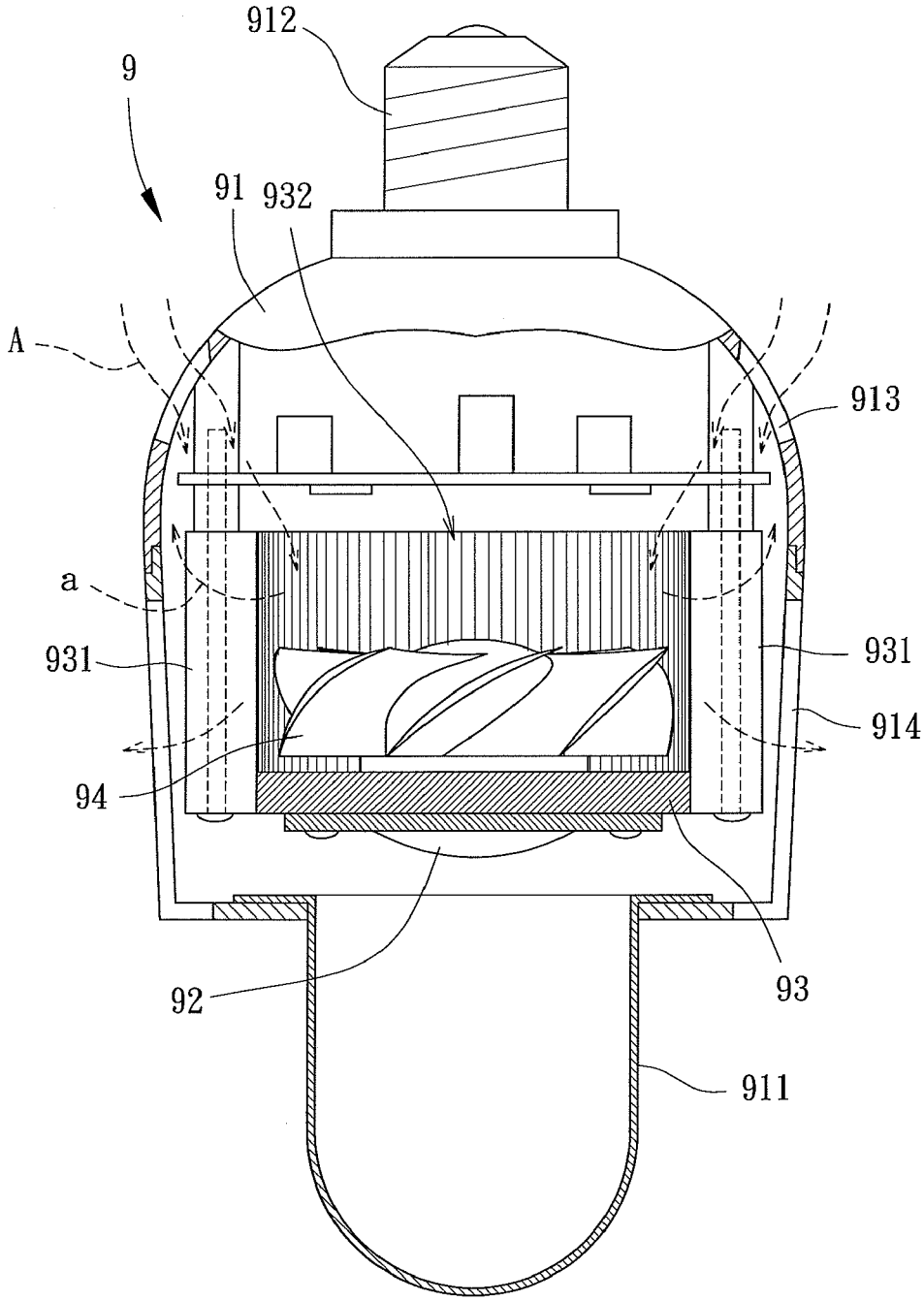
FIG. 1 PRIOR ART
FIG. 1 is a cross sectional view illustrating a conventional lamp.

In the various figures of the drawings, the same numerals designate the same or similar parts. Furthermore, when the terms "first", "second" and similar terms are used hereinafter, it should be understood that these terms are reference only to the structure shown in the drawings as it would appear to a person viewing the drawings and are utilized only to facilitate describing the invention.

DETAILED DESCRIPTION OF THE INVENTION

Figure 2:
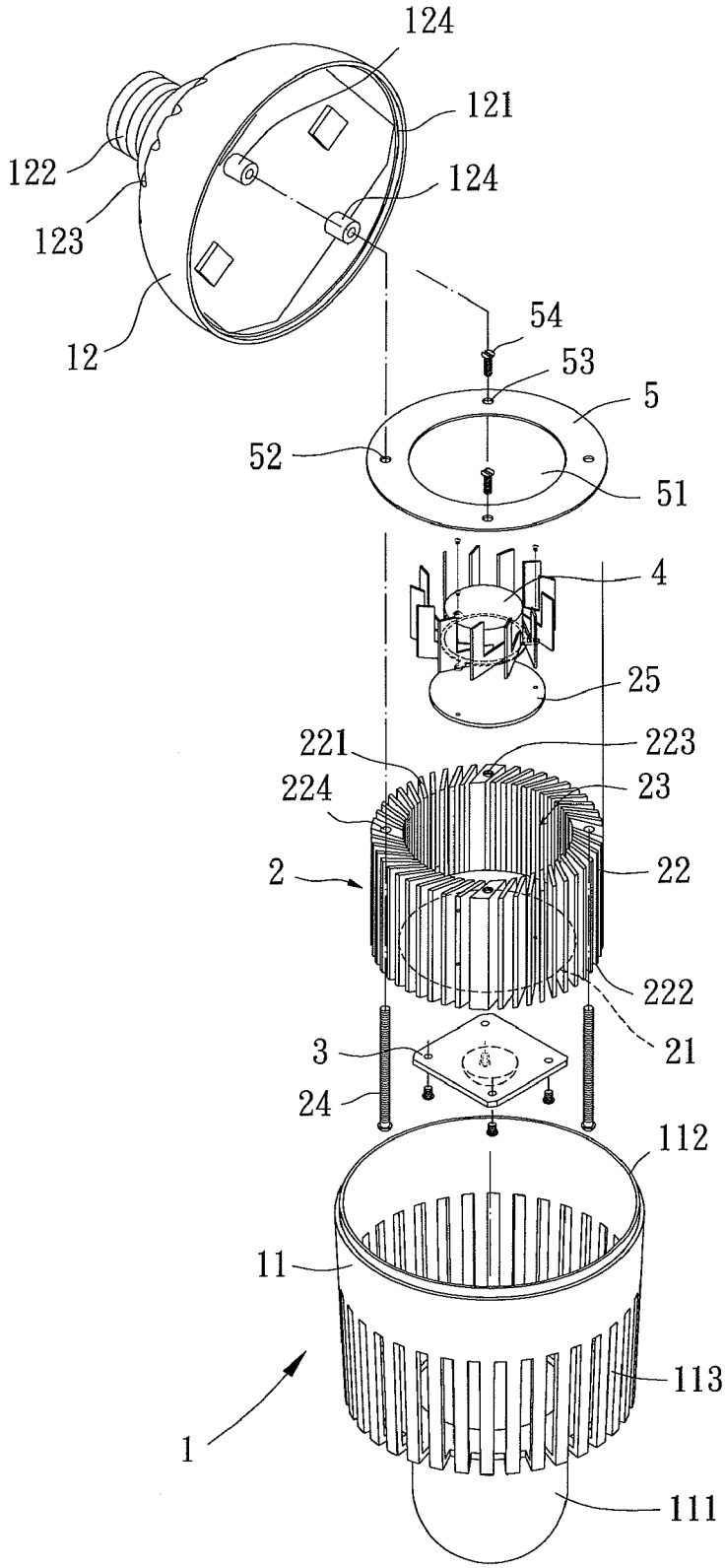
FIG. 2 is an exploded perspective view illustrating a lamp in accordance with a first embodiment of the present invention.
Figure 3:
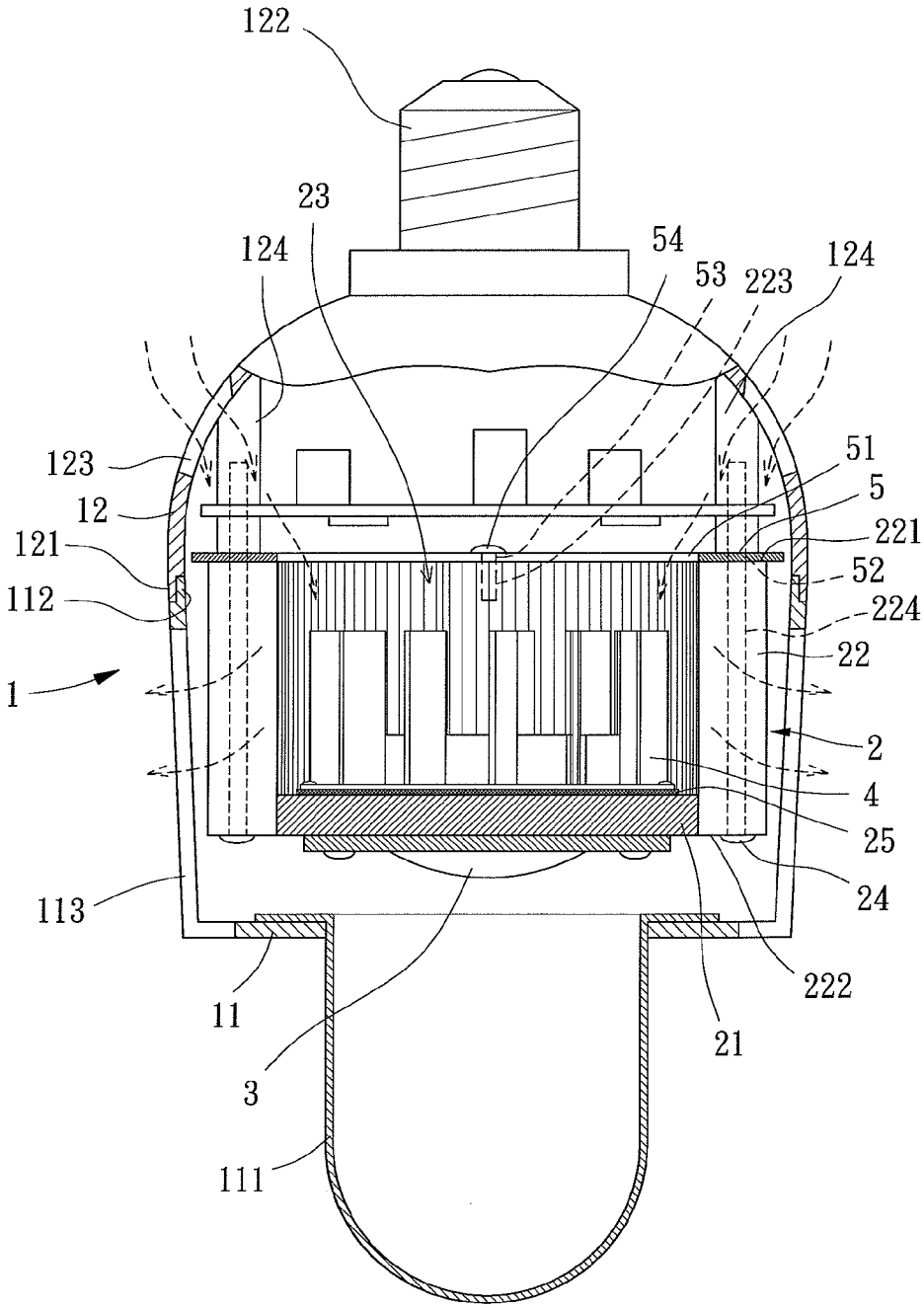
FIG. 3 is a cross sectional view illustrating the lamp in accordance with the first embodiment of the present invention.

A lamp of a first embodiment according to the preferred teachings of the present invention is shown in FIGS. 2 and 3 of the drawings. According to the first embodiment form shown, the lamp includes a housing 1, a heat sink 2, a light emitting member 3, a fan 4 and a blocking ring 5.

The housing 1 is preferred an integrally made hollow housing or a housing consisting of a plurality of pieces, which is provided for receiving some related components. In the first embodiment, the housing 1 includes a first shell 11 and a second shell 12. The first shell 11 has a lens 111 at one end thereof while the other end of the first shell 11 forms a first engaging portion 112. An outlet section 113 is formed on the wall of the first shell 11, preferably between the lens 111 and the first engaging portion 112 and in a shape of plural slots. One end of the second shell 12 forms a second engaging portion 121 for engaging with the first engaging portion 112 to form the whole housing 1 while the other end of the second shell 12 has a base 122. An inlet section 123 is formed on the wall of the second shell 12, preferably between the base 122 and the second engaging portion 121 and also in a shape of plural slots. Furthermore, a plurality of positioning protrusions 124 are formed on the inner surface of the second shell 12 and faces the first shell 11 when said first and second shells 11, 12 are assembled, with each positioning protrusion 124 preferably having an axial hole (not labeled).

The heat sink 2 is mounted inside the housing 1 and made of thermally conductive materials such as aluminum. The heat sink 2 includes a base plate 21 and a plurality of fins 22 close to the outlet section 113 of the housing 1 and arranged around the base plate 21 with intervals to form a chamber 23. Each of the fins 22 has a first end 221 facing the inlet section 123 of the housing 1 and a second end 222 connecting with the base plate 11. Some of the fins 22 of the heat sink 2 have a plurality of positioning holes 223 at the first ends 221 of the fins 22; furthermore, some of fins 22 with the positioning holes 223 or not have a plurality of through holes 224 with two ends thereof at the first and second ends 221, 222 of the fins 22. A plurality of first fixing members 24, such as screws, bolts or non-threaded pins, extends through the through holes 224, with one end of each first fixing member 24 being fixed in the axial hole of each positioning protrusion 124 of the second shell 12, so as to firmly mount the heat sink 2 inside the housing 1. Besides, there is preferably a cushion 25 disposed inside the chamber 23.

The light emitting member 3 is preferably selected from a light-emitting diode (LED), a bulb or any other components that can emit light after an electric current passes. The light emitting member 3 is fixed to the base plate 21 of the heat sink 2 and faces the lens 11 of the housing 1, with the light emitting member 3 electrically connecting to the base 122 of the housing 1 by plural leads (not illustrated).

The fan 4 is fixed inside the chamber 23 of the heat sink 2 and is preferably fixed on the cushion 25 for reducing vibration of the operating fan 4, so as to reduce the noise resulting from the vibration.

The blocking ring 5, which is mounted inside the housing 1 and between the inlet section 123 and the heat sink 2, has an inlet hole 51 aligned with the chamber 23 of the heat sink 2. Preferably, the inlet hole 51 extends axially along a central line of the blocking ring 5. Furthermore, around the inlet hole 51, the blocking ring 5 has a plurality of first through holes 52 for the first fixing members 24 to extend through and a plurality of second through holes 53 for a plurality of second fixing members 54, such as screws, bolts or non-threaded pins, to extend through. One end of each second fixing member 54 is fixed in each positioning hole 223 of the heat sink 2, so that the blocking ring 5 is fixed on the first ends 221 of the fins 22 of the heat sink 2. Besides, with reference to FIG. 3, an outer diameter of the blocking ring 5 is preferred larger than that of the heat sink 2, so that a gap letting air flows flow back to the inlet section 123 after passing by the fins 22 is largely reduced.

When using the lamp of the present invention, it is coupled to a lamp holder (not illustrated) on a wall, ceiling or table with the base 122 electrically connecting to a power supply through the lamp holder, so that the light emitting member 3 emits light penetrating the lens 111 for illuminating. Color of the lens 111 can be selected from various colors, such as green, yellow, red etc.; hence, the light emitting member 3 is able to emit the desired color of light through the colored lens 111. Furthermore, heat generated by the light emitting member 3 can be transmitted to the fins 22 of the heat sink 2 and then be transferred to outside the housing 1 through the outlet section 113 by air flows which flow through the inlet hole 51 of the blocking ring 5 and then pass through gaps between any two adjacent fins 22, with the fan 4 forming air intake through the inlet section 123. Therefore, heat dissipating effect is provided.

Referring again to FIG. 3, while the fan 4 sucks air, air flows pass through the inlet section 123 and flow into the chamber 23. And the blocking ring 5 is for blocking parts of the heated air flows from flowing back to the inlet section 123 through the gaps between any two adjacent first ends 221 of the fins 22 when the heated air passes by the fins 22. Therefore, turbulence near the inlet section 123 is avoided effectively and the air flows receiving the heat inside the housing 1 can flow smoothly to outer spaces of the housing 1 through the outlet section 113 to enhance heat dissipating efficiency of the heat sink 2 and the fan 4, so that life of the light emitting member 3 is extended.

Figure 4:
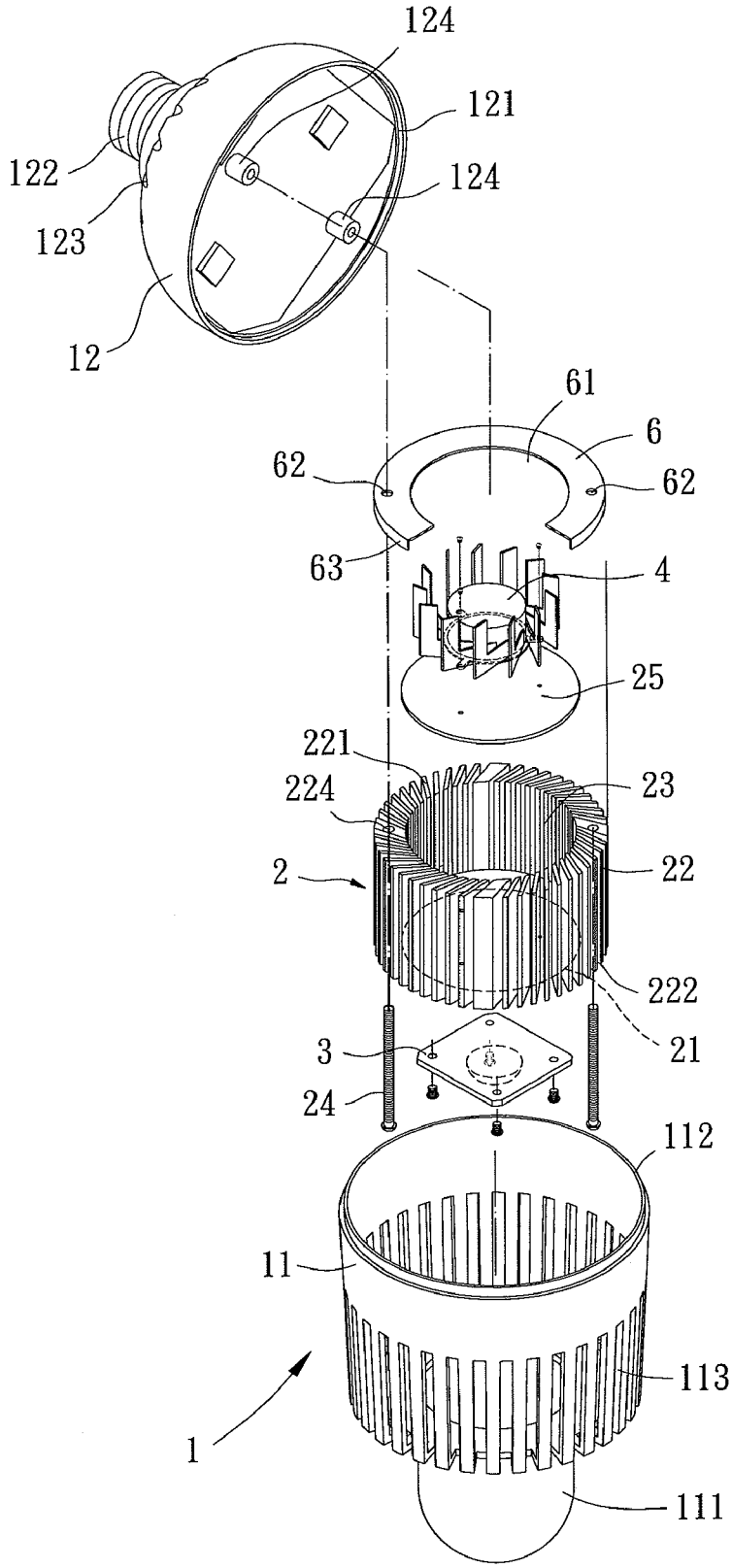
FIG. 4 is an exploded perspective view illustrating a lamp in accordance with a second embodiment of the present invention.
Figure 5:
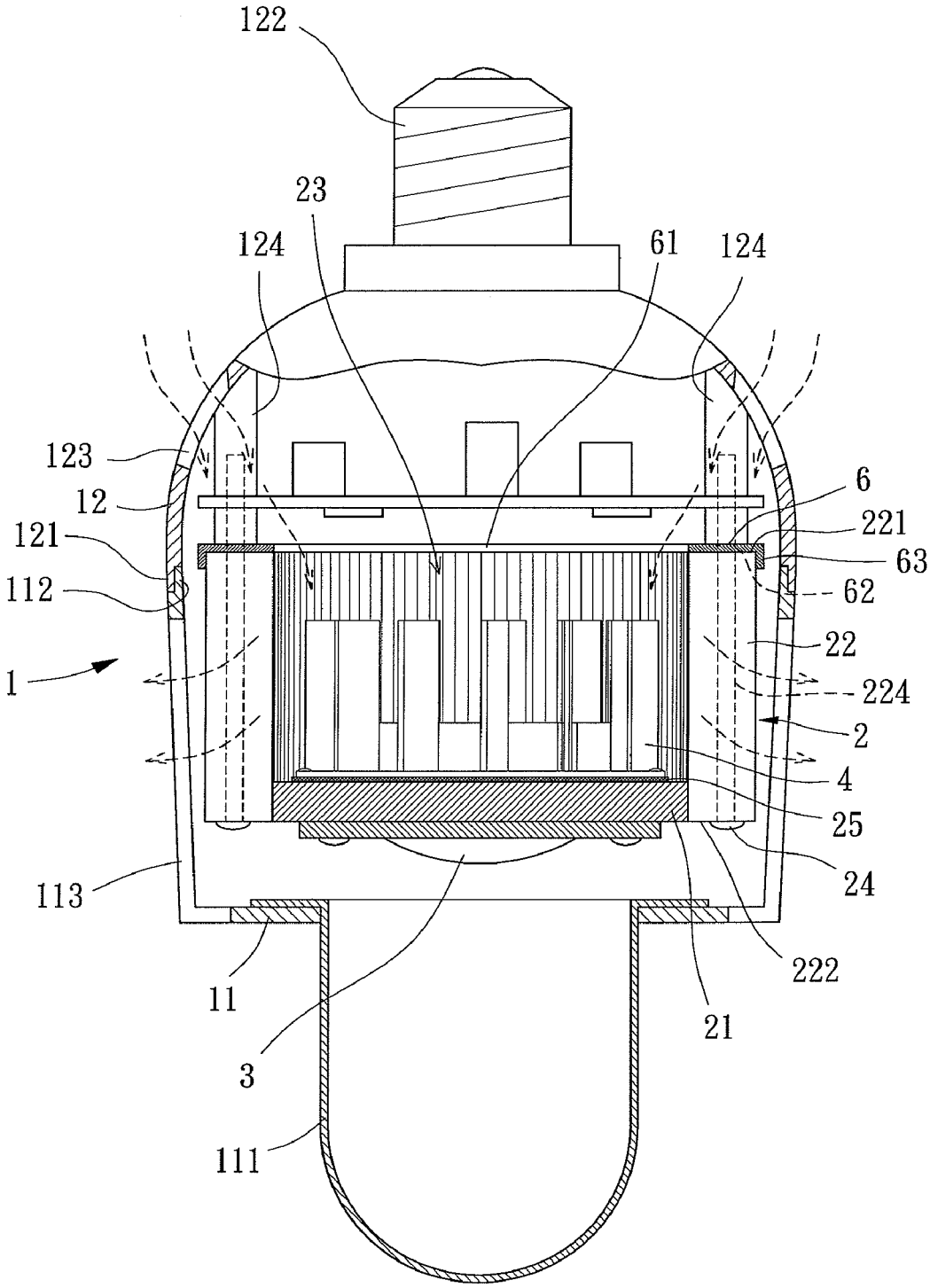
FIG. 5 is a cross sectional view illustrating the lamp in accordance with the second embodiment of the present invention.

FIGS. 4 and 5 show a lamp of a second embodiment according to the preferred teachings of the present invention modified from the first embodiment, which includes a housing 1, a heat sink 2, a light emitting member 3, a fan 4 and a blocking ring 6, wherein the heat sink 2 is without the positioning holes 223. The blocking ring 6 also is mounted inside the housing 1 and between the inlet section 123 and the heat sink 2 and has an inlet hole 61 aligned with the chamber 23 of the heat sink 2. The blocking ring 6 has a plurality of through holes 62 around the inlet hole 61, for the fixing members 24 to extend through. Preferably, the inlet hole 61 extends axially along a central line of the blocking ring 6. Besides, for the convenience of combination between the blocking ring 6 and the heat sink 2, the outer edge of the blocking ring 6 forms a flange 63 extending in a direction from the first ends 221 to the second ends 222 of the fins 22 to fit on the outer lateral wall of the fins 22 close to the first ends 221 thereof. Hence, the blocking ring 6 of the second embodiment of the present invention is able to block parts of the heated air flows from flowing back to the inlet section 123 through the gaps between any two adjacent first ends 221 of the fins 22 to avoid turbulence near the inlet section 123, such that heat dissipating efficiency of the heat sink 2 and the fan 4 is enhanced.

Figure 6:
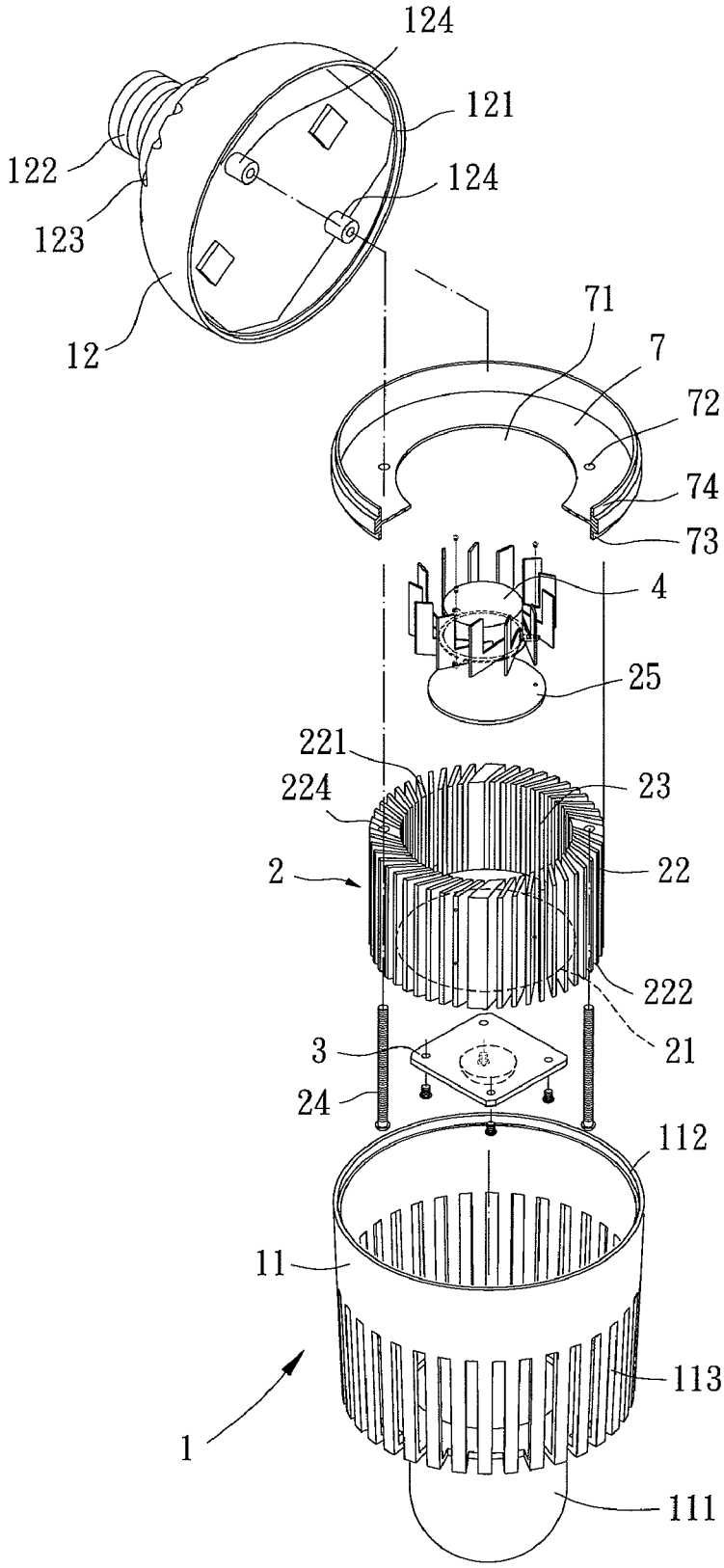
FIG. 6 is an exploded perspective view illustrating a lamp in accordance with a third embodiment of the present invention.
Figure 7:
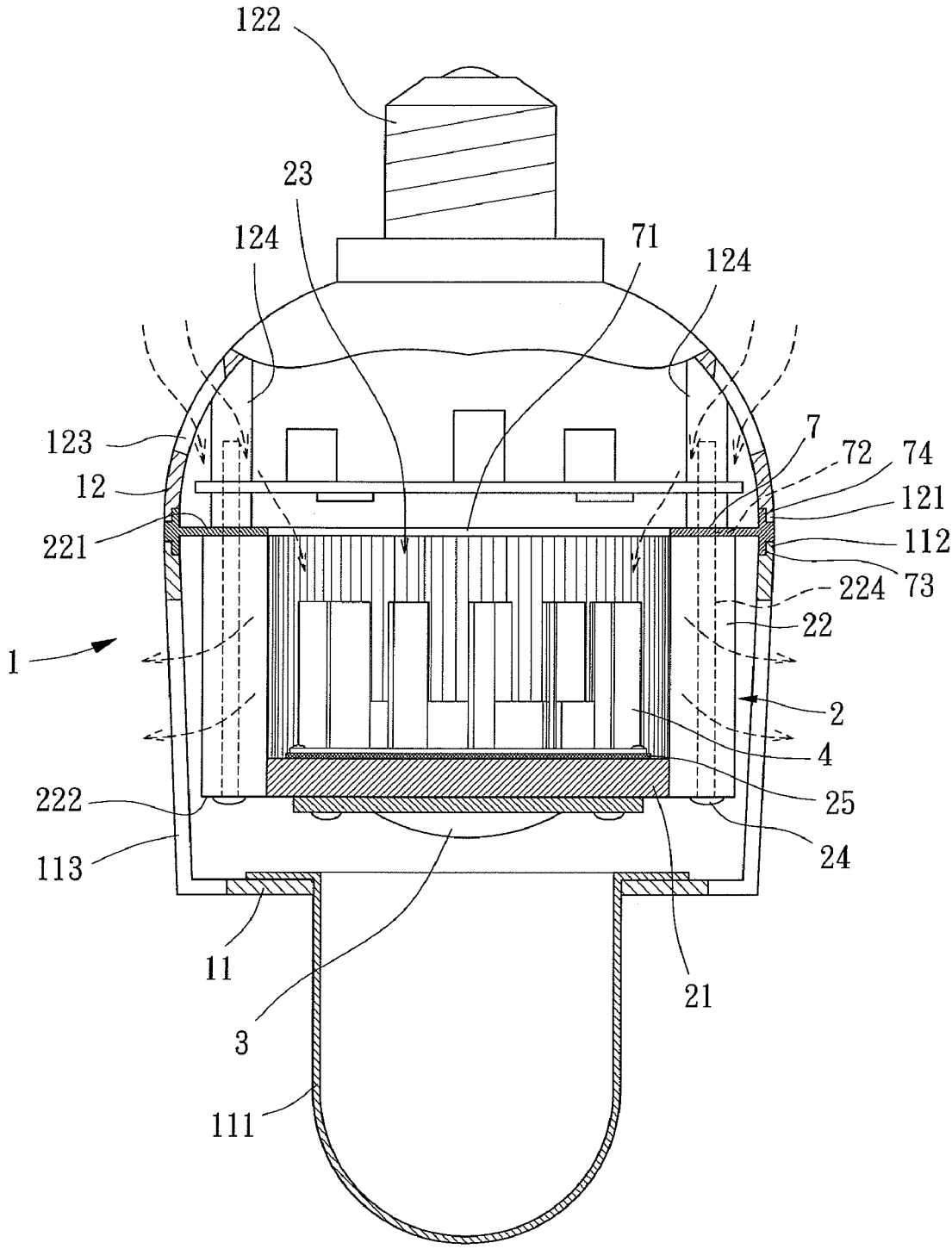
FIG. 7 is a cross sectional view illustrating the lamp in accordance with the third embodiment of the present invention.

FIGS. 6 and 7 show a lamp of a third embodiment according to the preferred teachings of the present invention modified from the first embodiment, which includes a housing 1, a heat sink 2, a light emitting member 3, a fan 4 and a blocking ring 7, wherein the heat sink 2 is without the positioning holes 223. The blocking ring 7 also is mounted inside the housing 1 and between the inlet section 123 and the heat sink 2 and has an inlet hole 71 aligned with the chamber 23 of the heat sink 2. The blocking ring 7 has a plurality of through holes 72 around the inlet hole 71, for the fixing members 24 to extend through. Preferably, the inlet hole 71 extends axially along a central line of the blocking ring 7. Besides, the blocking ring 7 has a first flange 73 and a second flange 74 formed on two opposite sides of the outer edge thereof and extending axially from the outer edge thereof. Therefore, the blocking ring 7 can be combined with and between the first and second shells 11, 12, with the first engaging portion 112 of the first shell 11 contacting with the first flange 73 of the blocking ring 7 and the second engaging portion 121 of the second shell 12 contacting with the second flange 74 of the blocking ring 7 by means of one of close fit, interference fit, screwing and so on. As a whole, the blocking ring 7 is provided for combining the first and second shells 11, 12 together while the blocking ring 7 is sandwiched and fixed between the first and second shells 11, 12, so that the combinations between the blocking ring 7 and the first and second shells 11, 12 are firm. As a result, the blocking ring 7 of the third embodiment of the present invention is able to block parts of the heated air flows from flowing back to the inlet section 123 through the gaps between any two adjacent first ends 221 of the fins 22 to prevent turbulence near the inlet section 123 from occurring, such that heat dissipating efficiency of the heat sink 2 and the fan 4 is enhanced.

As has been discussed above, the lamp of the present invention provides the blocking rings 5, 6, 7 which are able to block parts of the heated air flows from flowing back to the inlet section 123, so that turbulence resulting from flowing back air flows is avoided. Consequently, the air flows risen by the fan 4 and receiving the heat inside the housing 1 can flow smoothly to out of the housing 1 through the outlet section 113 to enhance heat dissipating efficiency of the heat sink 2 and the fan 4, so that life of the light emitting member 3 is extended.

Although the invention has been described in detail with reference to its presently preferable embodiment, it will be understood by one of ordinary skill in the art that various modifications can be made without departing from the spirit and the scope of the invention, as set forth in the appended claims.

What is claimed is:

1. A lamp, comprising:

a housing including a lens and a base on two ends thereof, with an outlet section and an inlet section being formed on the wall of the housing;

a heat sink being mounted inside the housing and including a base plate and a plurality of fins, with the fins being close to the outlet section of the housing and arranged around the base plate to form a chamber, with each of the fins having a first end facing the inlet section of the housing and a second end connecting with the base plate;

a light emitting member being fixed to the base plate of the heat sink and facing the lens of the housing, with the light emitting member electrically connecting to the base of the housing;

a fan, being fixed inside the chamber of the heat sink, and forming air intake through the inlet section and moving air to the outlet section; and a blocking ring being mounted inside the housing and between the inlet section and the heat sink and including an inlet hole aligned with the chamber of the heat sink.

2. The lamp as defined in claim 1, wherein an outer diameter of the blocking ring is larger than that of the heat sink.

3. The lamp as defined in claim 2, wherein a plurality of positioning protrusions are formed on an inner surface of the housing, the blocking ring has a plurality of first through holes around the inlet hole, and some fins of the heat sink have a plurality of through holes with two ends thereof at the first and second ends, with a plurality of first fixing members extending through the through holes and the first through holes while one end of each first fixing member is fixed in each positioning protrusion of the housing, so as to firmly mount the heat sink inside the housing.

4. The lamp as defined in claim 3, wherein some of the fins of the heat sink have a plurality of positioning holes and the blocking ring has a plurality of second through holes around the inlet hole for a plurality of second fixing members to extend through, with one end of each second fixing member being fixed in each positioning hole, so that the blocking ring is fixed on the first ends of the fins of the heat sink.

5. The lamp as defined in claim 1, wherein an outer edge of the blocking ring forms a flange extending in a direction from the first ends to the second ends of the fins for fitting on an outer lateral wall of the fins close to the first ends thereof.

6. The lamp as defined in claim 5, wherein a plurality of positioning protrusions are formed on an inner surface of the housing, the blocking ring has a plurality of through holes around the inlet hole, and some fins of the heat sink have a plurality of through holes with two ends thereof at the first and second ends, with a plurality of first fixing members extending through the through holes of the fins and the through holes of the blocking ring while one end of each first fixing member is fixed in each positioning protrusion of the housing, so as to firmly mount the heat sink inside the housing.

7. The lamp as defined in claim 1, wherein the housing includes a first shell and a second shell engaging with each other.

8. The lamp as defined in claim 1, wherein there is a cushion disposed inside the chamber and the fan is fixed on the cushion.

9. A lamp, comprising:

a housing including a first shell having a lens and a first engaging portion disposed at two ends of the first shell and a second shell having a second engaging portion and a base disposed at two ends of the second shell, with an outlet section being formed on a wall of the first shell and an inlet section being formed on a wall of the second shell;

a heat sink being mounted inside the housing and including a base plate and a plurality of fins, with the fins being close to the outlet section of the housing and arranged around the base plate to form a chamber, with each of the fins having a first end facing the inlet section of the housing and a second end connecting with the base plate;

a light emitting member being fixed to the base plate of the heat sink and facing the lens of the housing, with the light emitting member electrically connecting to the base of the housing;

a fan, being fixed inside the chamber of the heat sink, and forming air intake through the inlet section and moving air to the outlet section; and a blocking ring being mounted inside the housing and between the inlet section and the heat sink and including an inlet hole aligned with the chamber of the heat sink, a first flange and a second flange formed on two opposite sides of the outer edge thereof and extending axially from the outer edge thereof, with the first engaging portion of the first shell contacting with the first flange of the blocking ring and the second engaging portion of the second shell contacting with the second flange of the blocking ring.

10. The lamp as defined in claim 9, wherein a plurality of positioning protrusions are formed on the inner surface of the second shell, the blocking ring has a plurality of through holes around the inlet hole, and some fins of the heat sink have a plurality of through holes with two ends thereof at the first and second ends, with a plurality of first fixing members extending through the through holes of the fins and the through holes of the blocking ring while one end of each first fixing member is fixed in each positioning protrusion of the housing, so as to firmly mount the heat sink inside the housing.

11. The lamp as defined in claim 9, wherein there is a cushion disposed inside the chamber and the fan is fixed on the cushion.

* * * * *